US010995584B2

(12) United States Patent
Noel

(10) Patent No.: US 10,995,584 B2
(45) Date of Patent: May 4, 2021

(54) FULLY ELECTRIC TOOL FOR DOWNHOLE INFLOW CONTROL

(71) Applicant: OURO NEGRO TECNOLOGIAS EM EQUIPAMENTOS INDUSTRIAIS S/A, Rio de Janeiro (BR)

(72) Inventor: Felipe Gherren Noel, Petropolis (BR)

(73) Assignee: OURO NEGRO TECNOLOGIAS EM EQUIPAMENTOS INDUSTRIAIS S/A, Rio de Janeiro (BR)

( * ) Notice: Subject to any disclaimer, the term of this patent is extended or adjusted under 35 U.S.C. 154(b) by 196 days.

(21) Appl. No.: 15/558,795

(22) PCT Filed: Oct. 26, 2016

(86) PCT No.: PCT/BR2016/050270
§ 371 (c)(1),
(2) Date: Feb. 6, 2018

(87) PCT Pub. No.: WO2017/070766
PCT Pub. Date: May 4, 2017

(65) Prior Publication Data

US 2018/0223625 A1 Aug. 9, 2018

(30) Foreign Application Priority Data

Oct. 29, 2015 (BR) ..... 1020150275048

(51) Int. Cl.
*E21B 34/06* (2006.01)
*E21B 47/07* (2012.01)
(Continued)

(52) U.S. Cl.
CPC ..... *E21B 34/066* (2013.01); *E21B 34/063* (2013.01); *E21B 47/06* (2013.01);
(Continued)

(58) Field of Classification Search
CPC ..... E21B 34/066; E21B 34/063; E21B 47/06; E21B 47/065; E21B 47/09; E21B 47/10;
(Continued)

(56) References Cited

U.S. PATENT DOCUMENTS 5,070,944 A * 12/1991 Hopper ..... E21B 34/066 166/66.7
5,597,042 A * 1/1997 Tubel ..... E21B 23/03 166/113
(Continued)

*Primary Examiner* — George S Gray
(74) *Attorney, Agent, or Firm* — Malin Haley DiMaggio & Bowen, P.A.

(57) ABSTRACT

A valve-type electric tool for downhole flow control using a holo-shaft motor. Said valve comprises: a housing provided with an infinitely variable choke where in seals work as gaskets both the outside and inside of the valve; a hollow-shaft servomotor inside said housing attached to a nut, and, additionally, when said motor is activated, the motor directly moves a sliding sleeve provided with an infinitely variable choke axis-wise said valve; and in which the movement of said motor is generated by of a spindle, created on the very same said sliding sleeve, and in which said valve is operated from the surface by a single electric cable.

3 Claims, 8 Drawing Sheets

(51) Int. Cl.
*E21B 47/06* (2012.01)
*E21B 47/09* (2012.01)
*E21B 47/10* (2012.01)

(52) U.S. Cl.
CPC ..... *E21B 47/07* (2020.05); *E21B 47/09* (2013.01); *E21B 47/10* (2013.01); *E21B 2200/06* (2020.05)

(58) Field of Classification Search
CPC . E21B 2034/007; E21B 43/12; E21B 2200/06
See application file for complete search history.

(56) References Cited

U.S. PATENT DOCUMENTS

| | | | | |
|---|---|---|---|---|
| 5,832,996 | A | 11/1998 | Carmody et al. | |
| 5,979,558 | A | 11/1999 | Bouldin et al. | |
| 6,253,843 | B1 | 7/2001 | Rawson et al. | |
| 6,715,558 | B2 | 4/2004 | Williamson | |
| 7,377,327 | B2 | 5/2008 | Jackson | |
| 2001/0054505 | A1* | 12/2001 | Carmody ..... | E21B 43/12 166/250.15 |
| 2012/0273224 | A1* | 11/2012 | Konschuh ..... | E21B 34/066 166/373 |

* cited by examiner

STATE-OF-THE-ART

FULLY ELECTRIC TOOL FOR DOWNHOLE INFLOW CONTROL

CROSS REFERENCE TO RELATED APPLICATIONS

This application claims priority to PCT Application No. PCT/BR2016/050270, filed on Oct. 26, 2016, which claims priority to Brazilian Patent Application No. BR 10 2015 027504 8 filed on Oct. 29, 2015.

FIELD OF THE INVENTION

The invention herein described refers to a fully electric tool for downhole inflow control. In more specific terms, it is an electric downhole valve. The purpose of the device is to improve control in operations for opening, closing and position shifting of downhole inflow control valves for intelligent completion of petroleum wells. Said valve can be used in operations for the production and injection of oil and natural gas in onshore and offshore wells.

BACKGROUND INFORMATION

Even though there is a constant search for alternative means of energy, there is still a need for producing a great amount of oil for worldwide demand.

One of the key components in terms of oil production is the completion string used in production and injection wells. Its high complexity—equipment wise—draws the attention of the related industries.

One of the main equipment components of a well completion system is the flow control valve, used both for injection and production. On conventional completion systems—which account for most wells worldwide, subsurface flow control valves are operated either mechanically through wireline operations or via hydraulic systems. Even though there are a few exclusively electric completion systems, such usage is in a very small scale when compared to hydraulic or electro-hydraulic systems.

Furthermore, the few downhole flow control valves which operate electrically and are available in the industry also make use of a hydraulic piston in order to operate the sliding sleeve, the component that controls the available area for the flow of the fluid produced/injected to the inside/outside of the production/injection string, thus characterizing itself as a hybrid electro-hydraulic system.

Hydraulic activation is a very trustworthy method of operation. However, it lacks a refined valve opening and closing control. For "on-off" type-valves, the conventional hydraulic activation system is perfectly applicable. However, for wells which require greater precision in the production output control—or injection—the valve must be capable of offering variable control. Such technology then becomes quite complex.

In order to attain a variable control in either direction between fully open to and from closed positions, downhole flow control valves—be they hydraulic or electro-hydraulic—must contain a series of additional mechanical components. The complexity of such components contributes to reducing the overall system reliability. When the opening and closing operations must be performed continuously (infinitely variable choke), in contrast with a variation in multiple, predefined stages, said complexity becomes even greater. Examples are: U.S. Pat. No. 5,979,558; U.S. Pat. No. 6,715,558; U.S. Pat. No. 7,377,327.

An additional important concern regarding the actuation systems for hydraulic, downhole inflow control valves is the need for control lines (usually quarter-inch tubes) connected to the valves and an HPU—Hydraulic Power Unit—installed on the top-side. This requires greater complexity in installing, operating and maintaining the system, thus elevating its cost considerably.

The downhole inflow control valve is a piece of equipment that is part of a well's intelligent completion system. Its main function is to control the injection or production output in multiple intervals along the well.

On most market-available equipment, output control takes place by moving a tubular part located inside the valve called a "sliding sleeve". The sliding sleeve contains ports (openings), which allow for the communication of fluids between the inside and outside of the production (or injection) completion string and the outer region. The sliding sleeve is located inside a housing that also contains openings for fluid communication. Two seal barriers—one above, one below—surround said housing openings.

For the opening procedure, the sliding sleeve is moved in a way such that its port or perforations match the frames of the housing openings. Closing takes place when the sliding sleeve perforations move away from the seal barrier and the inside of the tool no longer communicates with the outside.

In most cases the inflow control valve is remotely operated from the surface by a primary activation system of control lines and a power unit. A secondary system, which is mandatory for downhole operations, is used if the primary system suffers any sort of malfunction. The secondary system is activated by means of a mechanical tool through wireline operation.

Currently the conventional downhole valve control systems are either hydraulic or electro-hydraulic. On the former, a stationary production unit (SPU), located on the surface, supplies pressure through a control line, usually a quarter-inch metallic tube, in order to move the valve. The system uses an independent hydraulic opening line for each valve and a common line for closing. Therefore, in a well containing three isolated intervals, four hydraulic control lines are needed (see FIG. 6).

For the electro-hydraulic system, only one hydraulic control line, extending from the surface, passing through the wellhead, and reaching the downhole, inflow control valves is needed. The opening and closing of the valves are attained through a directional solenoid valve that is electrically activated, directing the hydraulic flow to the desired purpose. Still, the electro-hydraulic method does not eliminate the use of hydraulic control lines (and every malfunction linked to them) between the wellhead and the inflow control valves (see FIG. 7).

The main advantages of the fully electric system that is the object of the present invention are:

- Improved system reliability by eliminating the need of hydraulic lines and relying instead on the use of direct electric control through a single electric cable shared by all the electric tools and sensors installed downhole;
- Precise control of the valve operating positions, continuously between fully open and closed and consequently of the pressure drop and flow-rate across the valve;
- Significant reduction in the number of control lines used in the system, since only one electric control line is used;
- A hydraulic power unit installed on the surface is no longer needed.

An additional important aspect is the significant risk mitigation of control loss associated with hydraulic systems, such as leaks and pressure loss.

Said factors make the use of this equipment relevant to be considered for deep water wells or ultra-deep water operations. Published patents show several interesting documents on flow control devices.

As such, U.S. Pat. No. 5,832,996 presents an electro-hydraulic valve that uses a solenoid valve housed inside the downhole equipment. When submitted to hydraulic power—be it from the surface or from the wellhead—the valve directs the hydraulic line to the opening or closing of the chamber of the device, according to the desired operation. However, the system still retains the need for hydraulic lines as well as of an HPU.

U.S. Pat. No. 6,253,843 presents an electrically activated downhole safety valve, in which a linear actuator is attached to a screw that drives the outer part of a sleeve. The forward movement of the sleeve pushes a flapper valve to the open position, overcoming the opposing pressure from the spring, which otherwise keeps the opening shut. When the sleeve is retreated, the spring shuts the flapper valve, thus interrupting the string's production. However, using spring elements for an opposing force to the motor does not consist in a reliable flow control, making it unsuitable for production flow control valves. In contrast with the said U.S. Pat. No. 5,832,996, instead of a linear actuator and a number of other moving parts, the invention disclosed herein, in a much simpler embodiment, employs a hollow shaft motor and a spindle to provide linear motion to a sleeve.

SUMMARY OF THE INVENTION

In a broad sense, the current invention is a downhole inflow control valve with fully electric activation, it comprising a substantially tubular external housing and an internal sleeve that moves axially inside said housing. A hollow shaft servomotor also contained inside the housing, whose axis is aligned with those of the said sleeve and housing, is in charge of controlling the axial, forward and backward motion of the said sliding sleeve. First and second seals placed in the annulus formed by the internal wall of the housing and external wall of the sleeve isolate the hollow shaft motor as well as all electrical and electronic components from the downhole fluid.

The downhole inflow control valve of the invention with fully electric activation comprises:

a) a substantially tubular external housing provided with an infinitely variable choke and, inside said housing, b1) an axially moving internal, sliding sleeve provided with an infinitely variable choke axis-wise on the said inflow control valve; and b2) a hollow shaft servomotor attached to a nut, the axis of the servomotor being aligned with those of the said internal, sliding sleeve and said housing, the servomotor being in charge of controlling the axial, forward and backward motions of the said internal, sliding sleeve;

c) a first seal placed in the annulus formed by the internal wall of the said housing and the external wall of the said internal sleeve above said hollow shaft motor, and a second seal placed in the annulus formed by the internal wall of the said housing and the external wall of the said internal sleeve bellow said hollow shaft motor, in order to isolate the said hollow shaft motor as well as all electrical and electronic components from the downhole fluid;

d) a third seal located below the said infinitely variable choke of the said housing; and e) a sensing system comprising i) at least one of a position sensor to indicate the said control valve's position; ii) at least one of a temperature sensor for monitoring and diagnosing the hollow-shaft servomotor operation; iii) at least one of a pressure sensor for production monitoring and diagnosis; iv) at least one of an output sensor for production flow control; and accelerometers; and where the movement of the said servomotor is generated by means of a spindle, mounted on the very same sliding sleeve, and in which said control valve is operated from the surface by means of a single electric cable.

The opening and closing of the valve of the invention are defined by the position of the said infinitely variable choke of the said sliding sleeve. When the position of said infinitely variable choke of the said sliding sleeve matches that of the said infinitely variable choke of the housing, the valve of the invention is opened. In turn, the closed position of the said valve is defined by the infinitely variable choke of said sliding sleeve moving past the said third seal located below the infinitely variable choke of the housing, thus completely shutting the infinitely variable choke of said housing.

As such, the current invention consists of a fully electric downhole valve, devoid of any hydraulic lines.

The invention also is comprised of a downhole valve with accurate controls for opening, closing and shifting positions.

The invention also is comprised of a downhole valve that uses only a single electric control line.

Additionally the invention is comprised of a downhole valve which eliminates the need for a surface hydraulic power unit.

DETAILED DESCRIPTION OF THE INVENTION

The current invention uses a new architecture for downhole valve, being exclusively electric, aiming to ensure operability of the proposed system.

The valve described in the present specification is to be used in operations for the production (completion) in onshore and offshore wells as well as in natural gas wells.

The concept of the invention shows that the present valve contains a sleeve that is contained within a motor. For such, a hollow-type motor is used, thus allowing for the configuration of the valve. Many are the advantages for that—which is to be presented on the following paragraphs of the present specification.

The following description of the present invention refers to the attached Figures.

Figure 1:
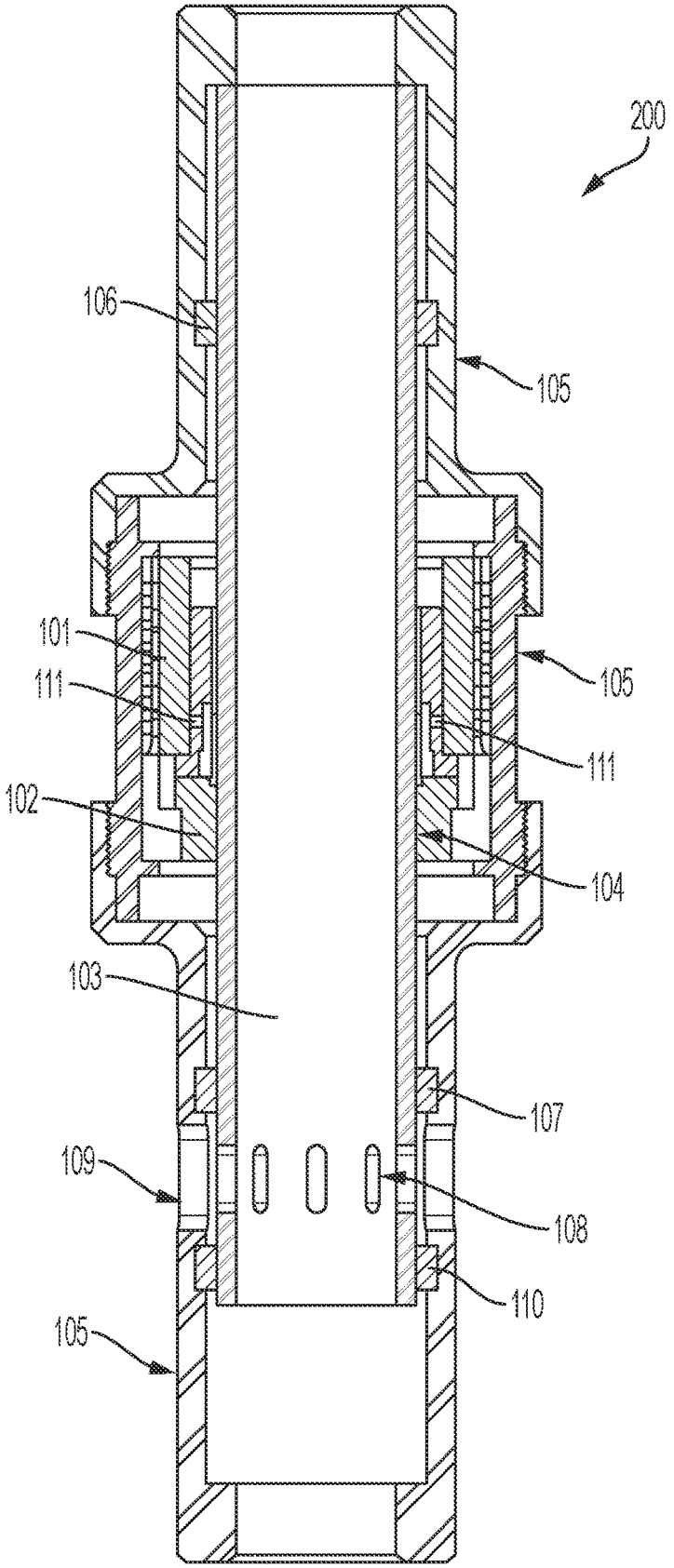
FIG. 1 shows a front elevational view in cross section, of the valve from the invention.

As shown in FIG. 1, the valve of the invention, generally designed by the numeral (200) comprises a hollow-shaft servomotor (101) attached to a nut (102). When activated, the servomotor (101) directly moves a sliding sleeve (103) axis-wise of the said valve (200).

The sliding sleeve's (103) movement is generated by means of a spindle (104) mounted on the said sliding sleeve (103) itself.

Figure 3:
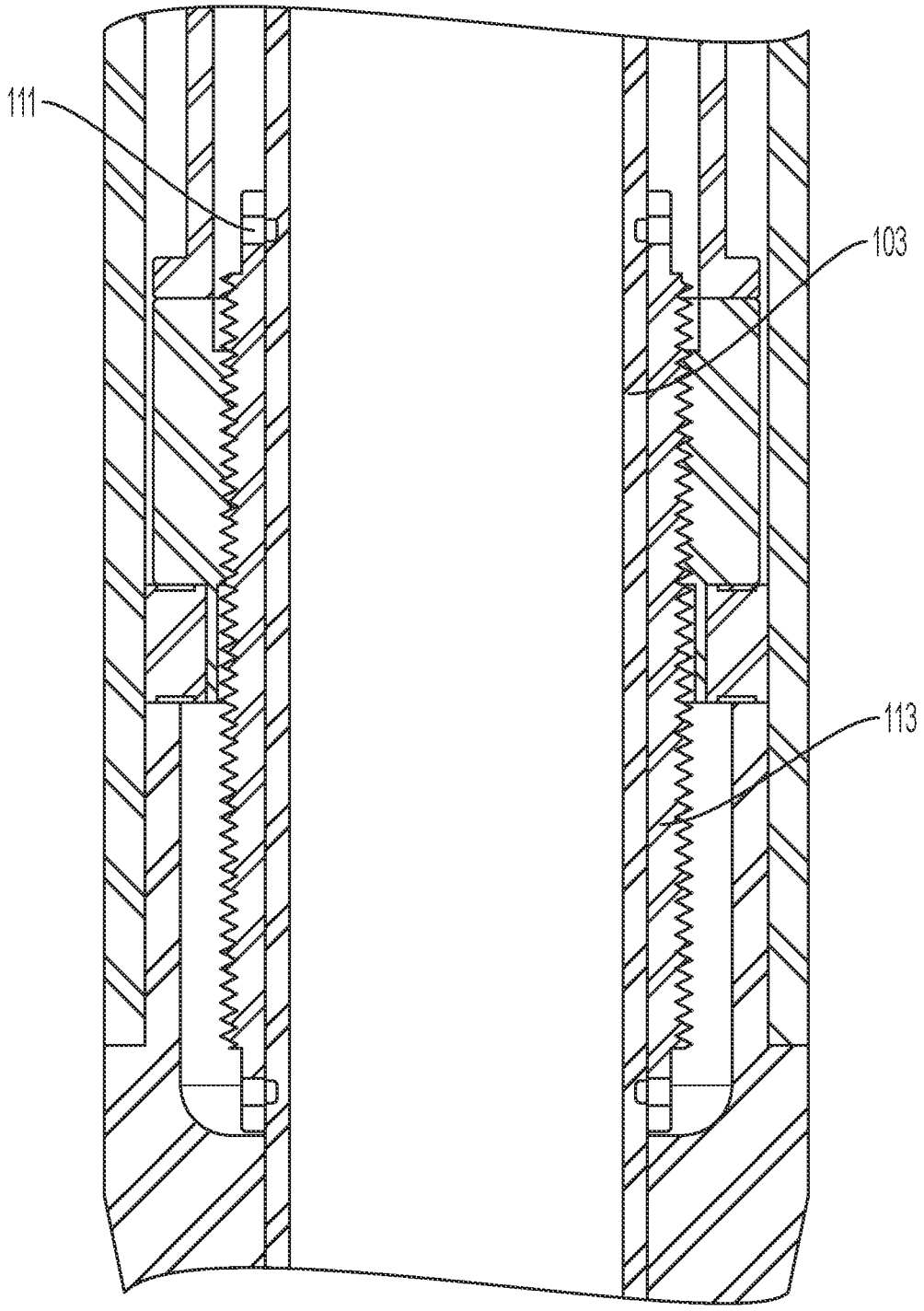
FIG. 3 shows a front elevational cross sectional view partially cut away of the spindle alternative, created separately from the sleeve.
Figure 4:
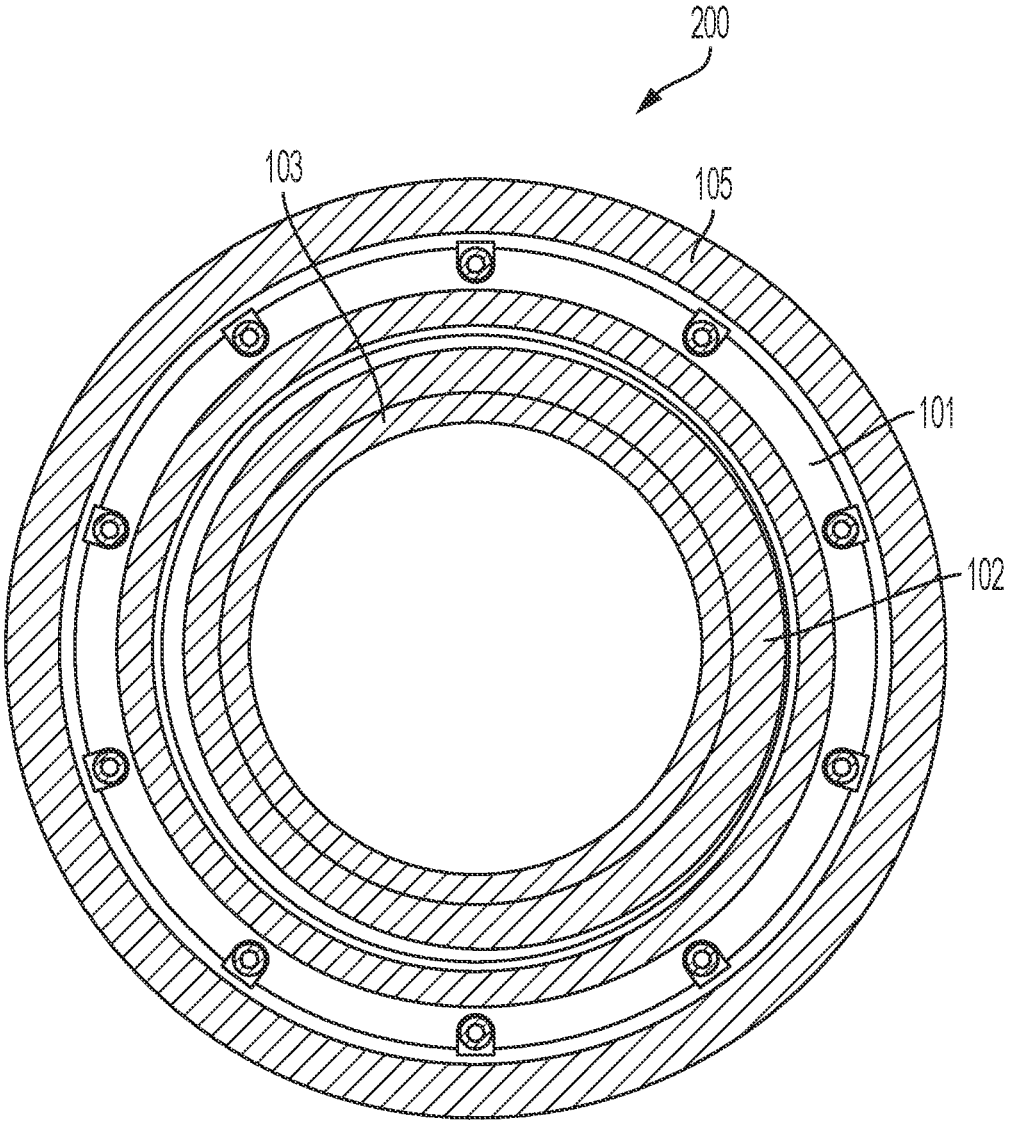
FIG. 4 shows a transversal view in cross section of the superior section of the valve from the invention.

Alternatively, the spindle may be an independent component, called a sleeve spindle (113) attached to the said sliding sleeve (103) by means of a shear pin (111) (see FIG. 3). As such, when there is a need for the use of activation tools through wireline operation (conventional operation using shifting tool(s)), the shear pins (111) are broken and the sliding sleeve (103) will then move independently from the said servomotor (101).

The motor (101) is completely protected by the housing (105) and by a first seal (106) and a second seal (107) which ensure complete sealing of the motor (101) from the inside and outside areas of the valve (200). Seal (106) is located above the motor (101) while seal (107) is located below the motor (101), both seals (106) and (107) being placed in the annulus (not represented) formed by the housing (105) and the said sliding sleeve (103).

The housing (105) is provided with an infinitely variable choke (109) designed to aid in the opening of said valve (200).

The valve's (200) opening and closing are defined by the position of the infinitely variable choke (108) of the sliding sleeve (103). When the position of said infinitely variable choke (108) matches that of the infinitely variable choke (109) of the housing (105), the valve (200) is opened.

Figure 2A:
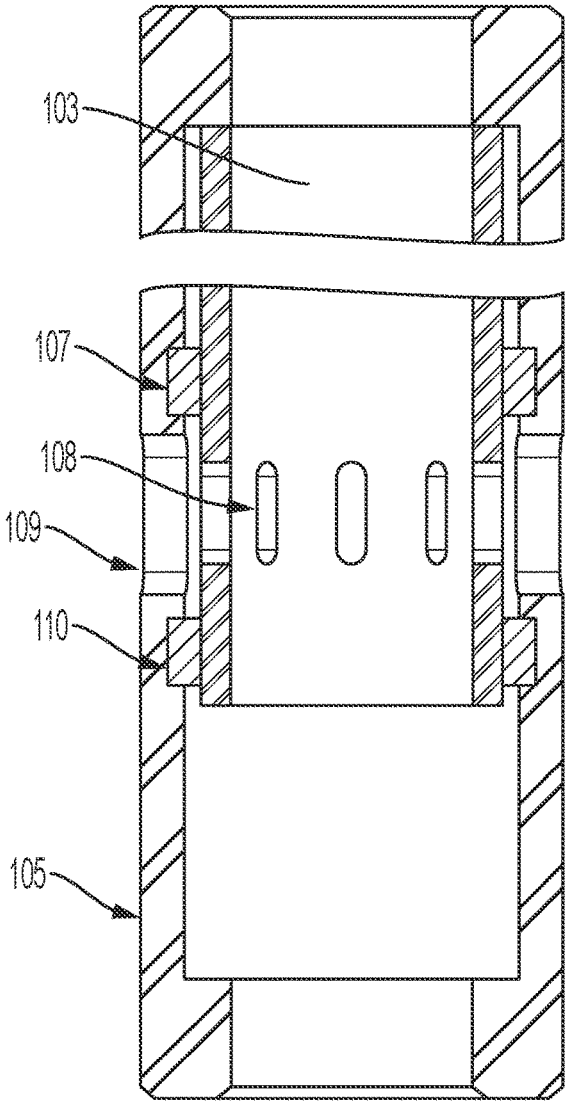
FIG. 2 shows a detailed view of the same valve in the open position (FIG. 2A) and closed position (FIG. 2B).
Figure 2B:
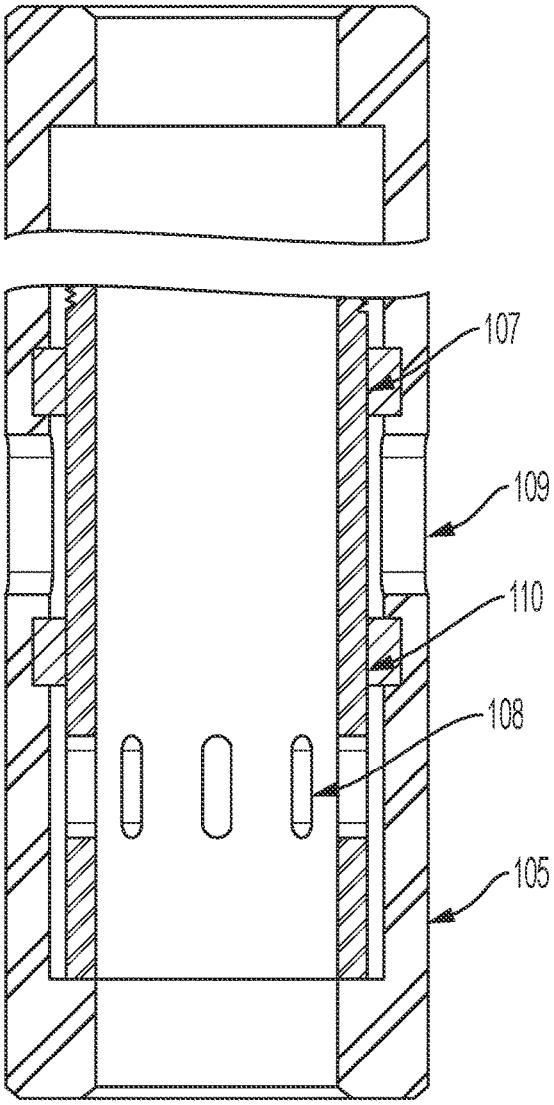

In turn, the closed position is defined by the infinitely variable choke (108) of sliding sleeve (103) moving past a third seal (110), located below the infinitely variable choke (109) of the housing (105) thus completely shutting the infinitely choke (109) of said housing (105), as shown in FIGS. 2A and 2B, respectively.

It is important to highlight that the infinitely variable choke (108) lining of the said sliding sleeve (103) (perforations for the fluid to flow in or out of the sleeve (103), must have excellent resistance to corrosion and incrustation. The preferred lining material is selected among tungsten carbides (e.g. Hardide), tungsten carbides with a Ni—Cr—B matrix (Conforma Clad, Amstar 888), Hexoloy (silicon carbide), AlNimax (aluminum nitride) or Moralide (silicon nitride). These, among others, are considered adequate.

Figure 8:
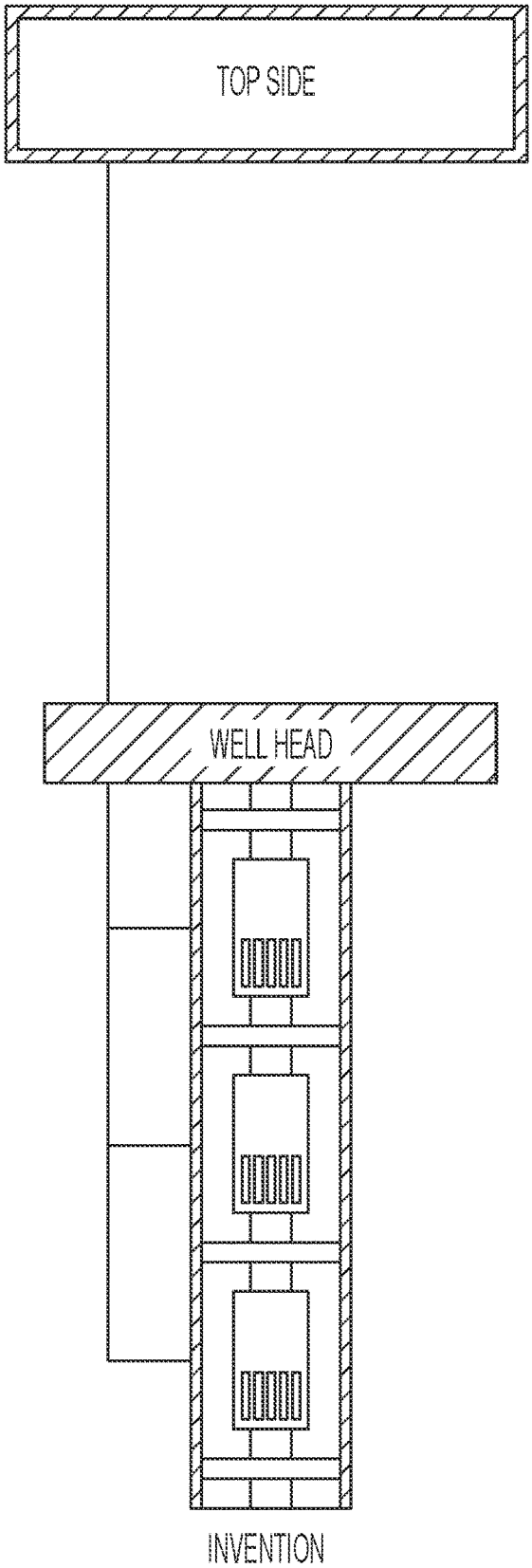
FIG. 8 is a schematic diagram representation of an exclusively electric system of the tool object of the invention for a 3-zone well.

The proposed valve (200) model has an exclusively electric activation by means of a single, quarter-inch, commercial electric cable (TEC cable) (112), capable of operating every valve inside the well (multiplex system), as shown in FIG. 8.

Sleeve (103) movement is enabled by means of the hollow-shaft electric motor (101), which applies torque directly to a nut (102). The nut (102) conveys the torque of the motor (101) to the sliding sleeve (103) through the spindle (104), said spindle (104) being created in the sliding sleeve (103) itself and the nut (102).

For the spindle/nut system, several technologies can be applied, such as a ball spindle, a planetary roller spindle, and a trapezoidal thread, among other existing technologies. Such aspect is not critical to the invention, and said object is not part of it.

The sliding sleeve (103) is restricted in terms of its rotation movement to a cotter pin, guide or similar parts. Such restrictions are not represented here and are common technical aspects. As such, all of the motor (101) torque will be transmitted linearly through the spindle (104), generating an axis-wise movement of the sliding sleeve (103).

The valve's (200) main output control is determined by the sliding sleeve's (103) opening position relative to the housing infinitely variable choke (109). The position is determined in the two following manners.

The first is through the motor (101) rotation control, which generates a linear movement of the sliding sleeve (103), originated from the spindle's (104) thread movement.

Figure 5:
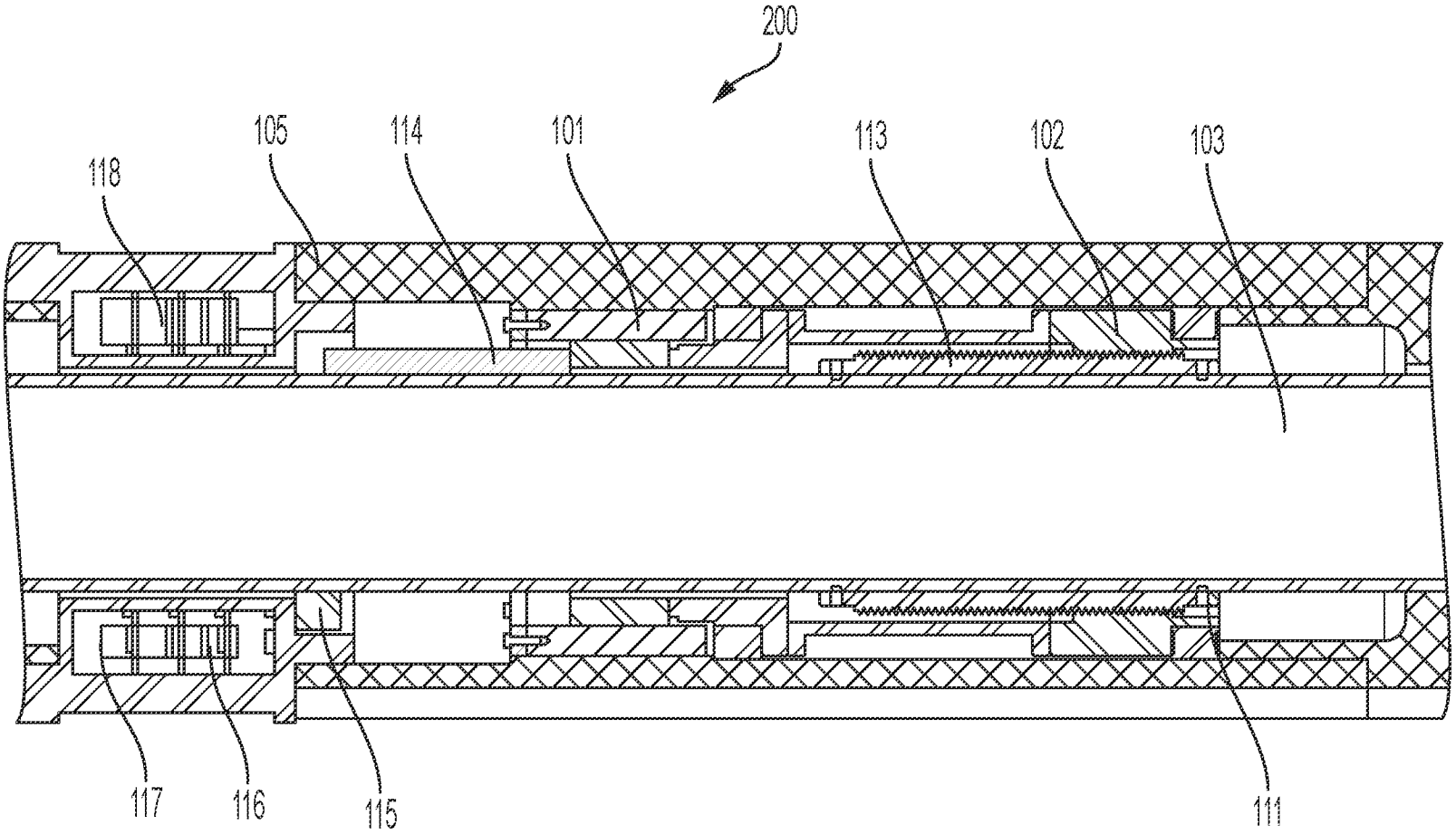
FIG. 5 shows a lateral cross sectional view of the valve of the invention, with the sensing part of the device comprising a position sensor, a temperature sensor, flow-rate sensor and a pressure sensor.
Figure 6:
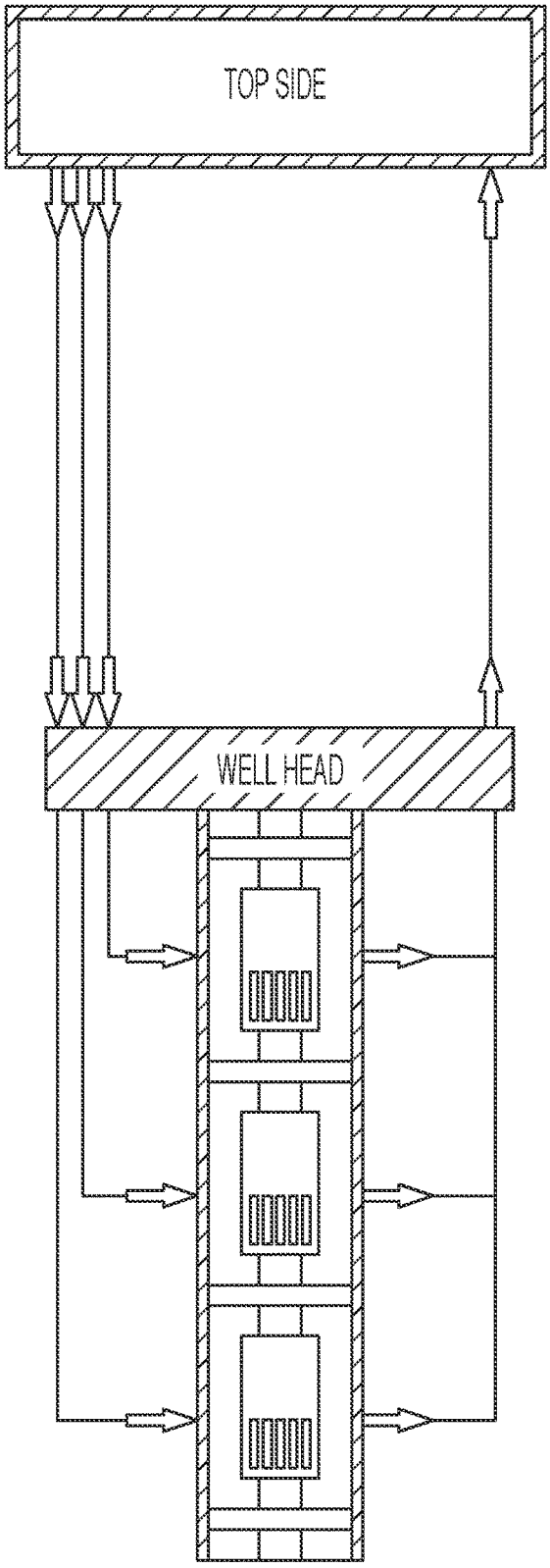
FIG. 6 is a schematic diagram representation of a conventional hydraulic flow control system for a 3-zone well.
Figure 7:
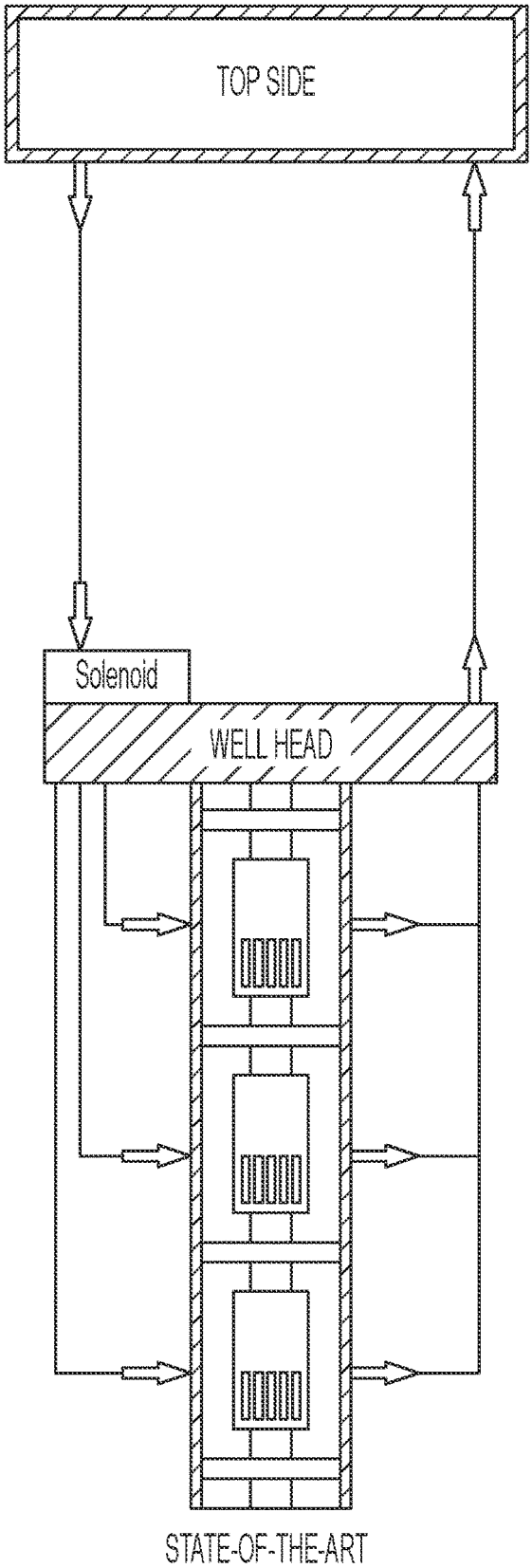
FIG. 7 is a schematic diagram representation of a conventional electro-hydraulic flow control system for a 3-zone well.

The second manner is redundant in relation to the first—the position is established by a sensor (114) that measures the position of the sliding sleeve (103) relative to said housing (105). The position sensor (114) is shown in FIG. 5.

The position sensor (114) is selected among a LVDT-type electronic sensor, resistant to temperatures of up to 125° C. and 5,000 psi pressure; LVDT-type electronic sensor, resistant to temperatures of up to 175° C. and 15,000 psi pressure, a micro electro-mechanical sensor, resistant to temperatures of up to 175° C. and 15,000 psi pressure, a micro electro-mechanical sensor, resistant to temperatures of up to 125° C. and 5,000 psi pressure, an optic sensor resistant to temperatures of up to 125° C. and 5,000 psi pressure and an optical sensor resistant to temperatures of up to 175° C. and 15,000 psi pressure.

As such, it is possible to precisely determine the valve's (200) opening percentage.

The motor (101) also contains a magnetically induced electronic brake (not shown), which helps ensuring the sliding sleeve (103) positioning without any undesirable movement.

The brake can be activated at any time during the operation. With this position sensor (114) and the previously described brake mechanism, the output control takes place from 0 to 100% of the opening, and with infinite positions.

The valve (200) also contains (see FIG. 5) a minimum of one of a temperature sensor (115) for the hollow-shaft motor (101) operations monitoring and diagnosis.

The valve (200) described in the present specification further contains an integrated sensing system (118) for measuring quantities associated with both the operation of the said valve (200) as well as the storage/production/injection, such as a pressure sensor (116), temperature sensor (115), flow-rate sensor (117) and accelerometers (not shown).

What I claim is:

1. A downhole inflow flow electric control valve, for variable control of flow of the control valve from fully open to fully closed, comprising:

a substantially tubular external housing having an infinitely variable choke in an array of housing openings, in a plane perpendicular to a longitudinal axis of the housing;

an axially movable tubular internal sliding sleeve providing downhole inflow, having an external surface spindle, said internal sliding sleeve mounted adjacent to and coaxially inside said tubular external housing and said internal sliding sleeve containing an infinitely variable choke having a plurality of openings, in a plane perpendicular to an internal sliding sleeve longitudinal axis, to control flow into and out of said external tubular housing and said internal sliding sleeve;

a nut attached movably to and around said internal sliding sleeve spindle;

a hollow shaft servo-motor attached to the nut, the longitudinal axis of the servomotor being aligned coaxially with the longitudinal axis of the internal sliding sleeve and the longitudinal axis of the tubular housing;

first and second seals mounted in an annular space between an internal wall of the housing and an external wall of the internal sliding sleeve to isolate the hollow shaft servo-motor; and a third seal located below the infinitely variable choke of the housing;

wherein movement of the internal sliding sleeve infinitely variable choke between open and closed, is activated by the servo-motor which, when turned on, applies torque directly to the nut, which transmits the torque of the servo-motor to the sliding sleeve through the spindle, the control valve servo-motor being connected to and operated from a well surface by a single electric cable;

and further wherein the infinitely variable choke of said internal sliding sleeve, when moved to a closed position, moves below the third seal located below the said infinitely variable choke of the said housing.

2. The control valve, according to claim 1, wherein: in the open position, the infinitely variable choke of the sliding sleeve is aligned to the infinitely variable choke of the external housing.

3. A downhole inflow electric variable control valve for downhole inflow control in operations for the production and injection of oil and natural gas onshore and offshore wells comprising:

a substantially tubular external housing having an infinitely variable choke with openings in and around said external housing, and in a plane perpendicular to a longitudinal axis of the external housing;

an axially movable, internal sliding sleeve mounted adjacent to and coaxially inside said tubular external housing and said sliding sleeve having an infinitely variable choke with openings in and around said sliding sleeve in a plane perpendicular to an internal sliding sleeve longitudinal axis;

a spindle connected around said internal sliding sleeve for providing movement to said internal sliding sleeve;

a nut attached movably to and around said internal sliding sleeve spindle;

a hollow shaft servo-motor attached to the nut, the longitudinal axis of the servo-motor being aligned coaxially with the longitudinal axis of the internal sliding sleeve and the longitudinal axis of the external tubular housing;

a first seal and a second seal mounted in the annular space between an internal wall of the external tubular housing and an external wall of the internal sliding sleeve to isolate the hollow shaft servo-motor;

said first seal and said second seal mounted on one side of said external housing variable choke openings and said internal sliding sleeve variable choke openings;

a third seal located between the inside of the tubular external housing and the outside of the internal sliding sleeve on the opposite side of the infinitely variable choke openings of the tubular external housing than said first seal and said second seal;

said sleeve spindle fastened to the internal sliding sleeve by one or more shearing pins, whereby, when the shearing pins are broken by an activation tool, the sliding sleeve will move independently from the spindle, nut and servomotor; by activation tools to control the control valve;

wherein movement of the internal sliding sleeve infinitely variable choke between open and closed, is activated by the servo-motor which, when turned on, applies torque directly to the nut, which transmits torque of the servo-motor to the internal sliding sleeve through the spindle, the control valve servo-motor being connected to operate from the surface by a single electric cable;

wherein in the open position, the infinitely variable choke openings around and in the internal sliding sleeve are aligned to the infinitely variable choke openings of the tubular external housing around and in the housing, permitting flow from inside the internal sliding sleeve to outside the tubular external housing and further wherein the infinitely variable choke of said internal sliding sleeve, when moved to a closed position, moves below the third seal located below the said infinitely variable choke of the said housing.

* * * * *